United States Patent [19]

Lo et al.

[11] Patent Number: 5,005,384

[45] Date of Patent: Apr. 9, 1991

[54] MECHANISM FOR A COMBINATION PADLOCK

[76] Inventors: Tzung-I. Lo; Teng-Yun Wang, both of P.O. Box 96-405, Taipei 10098, Taiwan

[21] Appl. No.: 546,098

[22] Filed: Jun. 29, 1990

[51] Int. Cl.[5] ..... E05B 37/02

[52] U.S. Cl. ..... 70/25

[58] Field of Search ..... 70/22, 24–28

[56] References Cited

U.S. PATENT DOCUMENTS

| | | | |
|---|---|---|---|
| 1,226,895 | 5/1917 | Landeen | 70/26 |
| 1,857,399 | 5/1932 | Piagneri | 70/28 |
| 2,830,447 | 4/1958 | Miller | 70/25 |
| 3,817,063 | 6/1974 | Williams | 70/24 |

FOREIGN PATENT DOCUMENTS

| | | | |
|---|---|---|---|
| 412633 | 1/1946 | Italy | 70/28 |

*Primary Examiner*—Lloyd A. Gall

[57] ABSTRACT

It is an improvement for a combination padlock, which comprises mainly a main shaft for mounting, a combination wheel assembly; the main shaft has a T-shaped slot for receiving a T-shaped block therein. There are two springs being mounted between the T-shaped block and the T-shaped slot; the main shaft has a center hole for loading two lock tumblers therein; there is a spring being mounted between the two lock tumblers to maintain a pushing force to the tumblers. After the main shaft is mounted with the combination wheel assembly, an end cap is fixedly attached to an end of the main shaft. Since there is a given flexible distance between the two lock tumblers set with the T-shaped block, the padlock can be locked up or unlock easily under a security condition.

3 Claims, 4 Drawing Sheets

MECHANISM FOR A COMBINATION PADLOCK

BACKGROUND OF THE INVENTION

1. Field of the Invention

This invention relates to a combination padlock, and particularly to a combination padlock, of which the combination numbers can be changed if necessary. Several combination rings are mounted on the outer surface of the body portion, and a T-shaped block is used for controlling the lock-up and unlocked conditions of the padlock.

2. Description of the Prior Art

In the prior art of the combination lock, several combination disks are used therein. The position and using purpose of the combination disks make a considerable difference from padlock to padlock. Generally, the combination padlocks are classified as follows:

A combination lock provided on a Chain, of which one end is mounted with a bar-type combination lock, while the other end thereof has a cylindrical member to be inserted in the bar-type combination lock. The combination lock comprises plate springs, positioning blocks, and combination disks to control the lock-up and unlocking conditions; however, the structure of the aforesaid type is unable to be used in a combination padlock.

A combination lock for a suitcase, which mainly comprises a plate with several slots so as to have the combination disks exposed out of the plate for operation. As a result of limit in space, most parts thereof are in a flat plate form to control the operation of the lock. Some padlocks are made of such structure by means of a case member first before assembling other parts such as the combination disks and shackle. Since all the combination disks are to be operated through a series of slots, it is rather inconvenient to a user, aside from the drawback of being difficult to assemble as a result of the parts being much smaller in size.

SUMMARY OF THE INVENTION

In view of the drawbacks of the conventional combination locks, the inventor has developed a new combination padlock, in which the combination wheel assembly is directly mounted on the body portion of the lock, and the combination numerals thereof can be changed easily, if necessary.

The prime object of the present invention is to provide a combination padlock, in which the main shaft of the body portion has a T-shaped slot for receiving a T-shaped block. Between the T-shaped slot and the T-shaped block, there are small springs so as to let the T-shaped block maintain a flexible condition to move up and down. One side of the body portion has a round hole for receiving two lock tumblers and a spring between the two lock tumblers; the spring is used to provide a flexible movement for the two lock tumblers. The outer ends of the two lock tumblers are formed into two semi-spherical portions respectively, which are to be engaged with two semi-circular recesses on both ends of the shackle respectively. The main shaft of the body portion is mounted with a combination wheel assembly, which has several driving rings; each of the driving rings has a recess. When the padlock is unlocked, all the recesses of the driving rings are aligned with the T-shaped slot so as to facilitate the T-shaped block to move upwards; then, the two lock tumblers are to be in a free-movement condition, and the shackle will be pushed upwards with a spring.

Another object of the present invention is to provide a combination padlock, in which the main shaft has a round groove for mounting a retaining ring after the combination wheel assembly is mounted on the main shaft. A cap with a round hole is to be mounted on the main shaft, and the round hole must be aligned with the shackle hole on the main shaft. The lower part of the shackle hole has a screw hole for receiving a screw; the lower end of that screw has a short stud, which can be lifted up a small height to facilitate the cap to move outwards at a small space; then, the combination ring can be moved outwards at a space equal to a half width of the combination ring so as to change the combination numerals of the padlock, if necessary.

Still another object of the present invention is to provide a combination padlock, in which the combination wheel assembly includes several combination rings, driving rings and partition rings. The outer surface of each of the driving rings is provided with a plurality of teeth, which are to be engaged with teeth on the inner surface of a combination ring; normally, the teeth on the driving ring are mainly used to actuate a driving ring to rotate. The partition ring is to be installed between two combination rings; the outer diameter of a partition ring is bigger than the inner diameter of the teeth in a combination ring, but is smaller than the diameter of the teeth base thereof so as to have the partition ring pulled out a half width of the combination ring upon changing the combination numerals.

DETAILED DESCRIPTION

Figure 1:
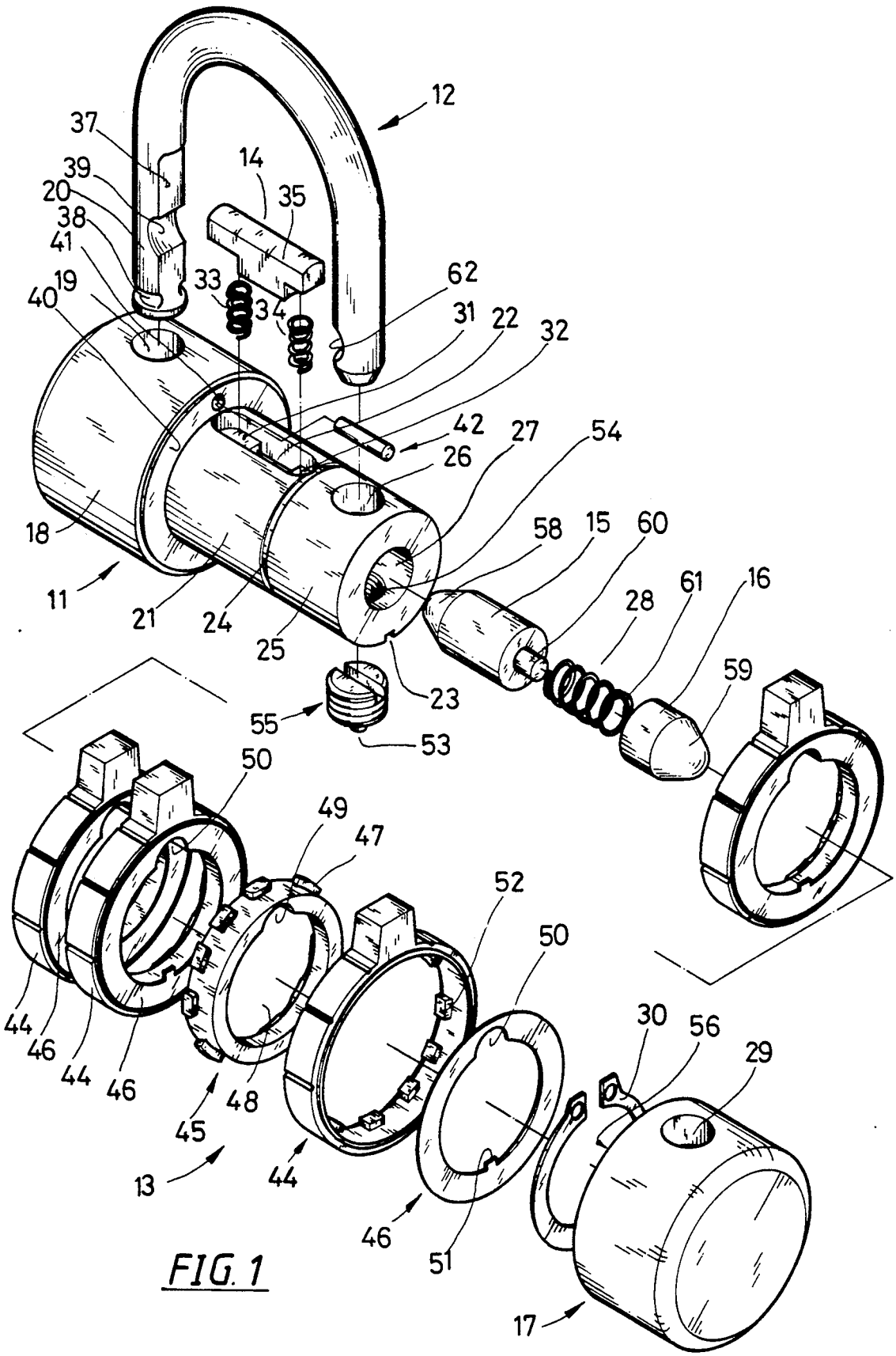
FIG. 1 is a disassembled view of an embodiment according to the present invention.

Referring to FIGS. 1 to 4, the present invention, an improved mechanism for a combination padlock, comprises mainly a body portion 11, a shackle 12, a combination wheel assembly 13, a T-shaped block 14, two lock tumblers 15 and 16, and a cap 17. The body portion 11 includes an outer shaft portion 18 with a shackle hole 19 for receiving a longer shackle end 20, a main shaft 21 with a T-shaped slot 22 and a key way 23. A T-shaped block 14 is movably mounted in T-shaped slot 22. The main shaft 21 is a smaller portion in diameter, on which a combination wheel assembly 13 is mounted. The main shaft 21 has a round groove 24 for receiving a retaining ring 30, whereby that combination wheel assembly 13 is retained on the main shaft 21. The inner shaft portion 25 has a shackle hole 26. The end of the main shaft 21 has a center hole 27, in which two lock tumblers 15 and 16 and a spring 28 are installed; finally, the inner shaft portion 25 is covered with a cap 17 having a round hole 29, which is in alignment with the shackle hole 26. One end of the shackle 12 is to be fitted in said shackle hole 19 in the outer shaft portion 18. After the two lock tumblers 15 and 16, and the spring 28 are mounted in the center hole 27, a T-shaped block 14 is movably mounted in a T-shaped slot 22, and the lower end of the T-shaped block 14 is to be fitted in a space between the two lock tumblers 15 and 16 when the lock is in locked-up condition. The locked-up and un-locked condition of the present invention is controlled with the position of the T-shaped block 14, i.e., whether the T-shaped block 14 is moved into the aligned recesses of the combination wheel assembly 13 or not; in un-locked condition for example, the two lock tumblers 15 and 16 are set in a free condition to release the shackle 12.

The outer shaft portion 18 of the body portion 11 has a shackle hole 19 with said spring 36 therein. The longer shackle end 20 is fitted in the shackle hole 19; the longer shackle end 20 has a round groove 38, a flat part 37, and a semi-circular recess 39. After the longer shackle end 20 is fitted in the shackle hole 19, a pin 42 is fixed in small hole 41 on the vertical surface 40 of the outer shaft portion 18 to retain the shackle 12 in place without being pulled out unintentionally. The flat part 37 of the shackle is used to limit the movement of the shackle upon being pulled out or pushed in; after the shackle 12 is pulled up to the highest position, the pin 42 is engaged with the round groove 38 to let the shackle rotate freely without being pulled out completely.

The main shaft 21 of the body portion 11 has a T-shaped slot 22, over which the combination wheel assembly 13 is mounted; both ends of the T-shaped slot 22 are provided with two flat parts 31 and 32 respectively for mounting two springs 33 and 34, on which the bottom ends 35 of the T-shaped block 14 are rested thereon so as to provide the T-shaped block 14 with a flexible movement for unlocking or locked-up condition.

The center of the main shaft 21 has a center hole 27 for movably mounting two lock tumblers 15 and 16. The center hole 27 is in communication with the lower slot part 43 of the T-shaped slot 22; the lower slot part 43 is used for receiving the lower end of the T-shaped block 14 so as to control the locked-up or unlocking condition of the padlock.

The combination wheel assembly 13 to be mounted on the main shaft includes several combination rings 44, several driving rings 45, and several partition rings 46. The outer surface of each driving ring 45 has a plurality of ring teeth 47, of which the width is equal to one half of that of the driving ring 45. The driving ring has a driving-ring hole 48 with a suitable diameter to be mounted on the main shaft 21; the driving-ring hole 48 has a recess 49. The partition ring 46 is substantially a thin ring with a recess 50 and a lug 51 therein. The lug 51 is to be engaged with a key way 23 under the main shaft 21 upon the partition ring 46 being assembled thereon so as to fix the partition ring 46 in place; the recess 50 is in alignment with the T-shaped slot 22. Inside the combination ring 44, there is a plurality of inner teeth 52, which can engage with the ring teeth 47 on the driving ring 45 upon the two rings being engaged together for locking or un-locking operation. After the combination wheel assembly 13 is mounted on the main shaft 21, one partition ring 46 is installed between two driving rings 45. The outer diameter of the partition ring 46 is longer than the inner diameter formed with the tops of teeth in the combination ring 44, but shorter than the diameter of the inner surface of the combination ring 44 so as to facilitate the combination ring 44 to move outwards a suitable space upon changing the combination numerals.

The T-shaped slot 22 in the main shaft 21 is used for installing the T-shaped block 14; the center hole 27 in the main shaft 21 is used for mounting two lock tumblers 15 and 16, and a spring 28 therein. The opposite ends of the lock tumblers have two studs 60 and 61 respectively for mounting the spring 28 in place without deviation. The outer two ends of the two lock tumblers 15 and 16 are formed into semi-spherical portions 58 and 59 respectively so as to mate with the semi-circular recesses 39 respectively. When the padlock is in un-locked condition, the distance between the two lock tumblers is bigger than the length of the lower end of the T-shaped block 14 so as to facilitate the T-shaped block 14 to fall into the space between the two lock tumblers under locked-up condition, and to let the T-shaped block raise into the recesses of the combination wheel assembly under unlocked condition.

After the combination wheel assembly is mounted on the main shaft, a retaining ring 30 is mounted in a round groove 24 on the main shaft so as to put the combination wheel assembly in place. The inner shaft portion of the main shaft has a shackle hole 26 for receiving the other end of the shackle 12. The lower part of the shackle hole 26 is a screw hole 54 for mounting a screw 55 therein. The inner shaft portion 25 is covered with a cap 17 so as to have the padlock formed into a complete piece in terms of appearance. The cap 17 has a round hole 56 in the center thereof for receiving the inner shaft portion 25, and it also has a round hole 29 on the top side thereof aligned with the shackle hole 26 for receiving the shackle. In the lower end of the round hole 29 in cap 17, there is a cylindrical hole 57 for receiving a screw 55. After the cap 17 and the screw 55 are mounted in place, the assembling operation of the padlock is completed.

The transmission structure of the present invention as shown in FIGS. 2, 6, 8 and 10 shows the padlock in unlocked condition; after the driving rings 45 and the combination rings 44 are in alignment, the recesses 49 of all the driving rings will be set right over the T-shaped slot 22 so as to provide a space to let the T-shaped block 14 move upwards. The T-shaped block 14 is to be lifted up by means of two springs 33 and 34 mounted between the T-shaped slot 22 and the T-shaped block 14. As soon as the T-shaped block 14 moves into the aligned recesses of all the driving rings 45, the lower end of the T-shaped block will be moved out of the space between the two lock tumblers 15 and 16; then, the two lock tumblers 15 and 16 will be under a free movement condition so as to let the shackle 12 move out freely. After the shackle is pulled straightly to an unlocked position, the longer shackle end 20 is still retained in the shackle hole 19 in a rotary manner by means a pin 42, a flat part 37 and a round groove 38.

Figure 2:
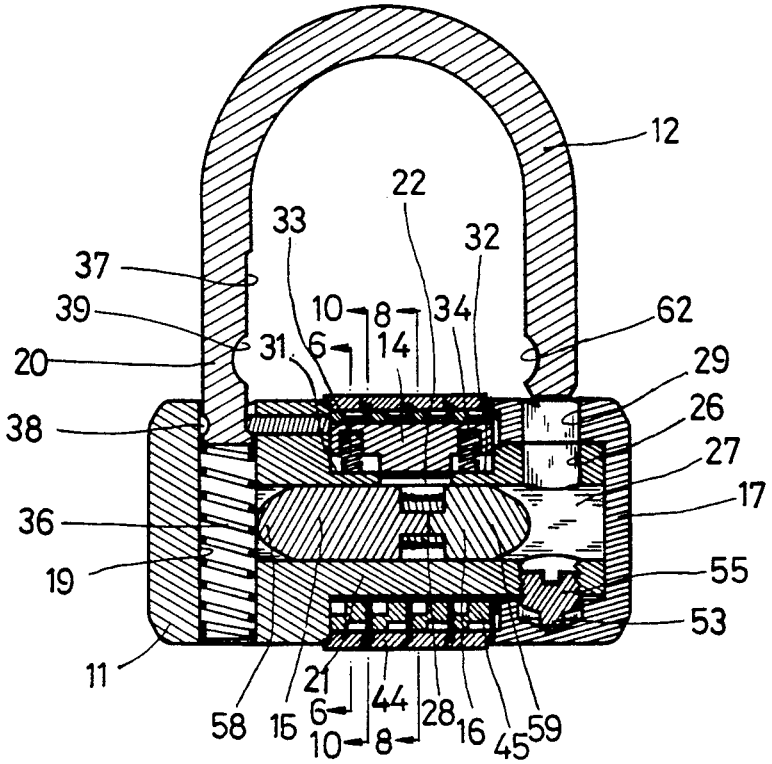
FIG. 2 is a sectional view of the present invention, showing the padlock in unlocked condition.
Figure 3:
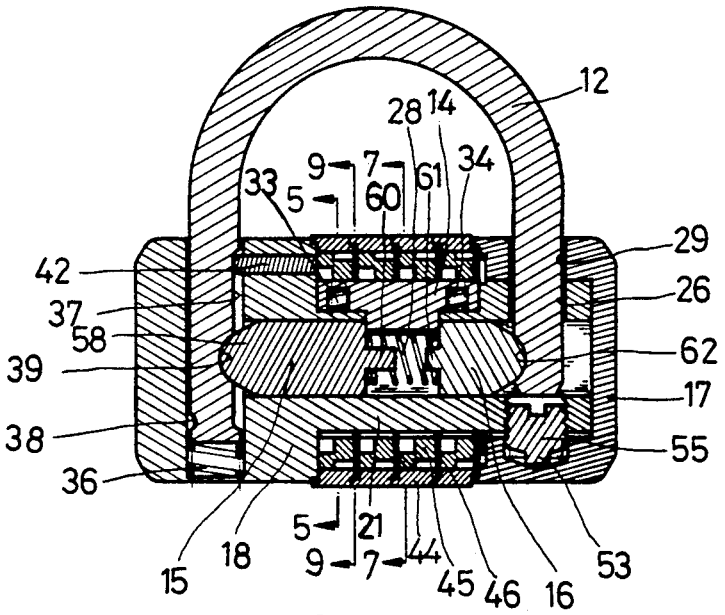
FIG. 3 is a sectional view of the present invention, showing the padlock in locked-up condition.
Figure 4:
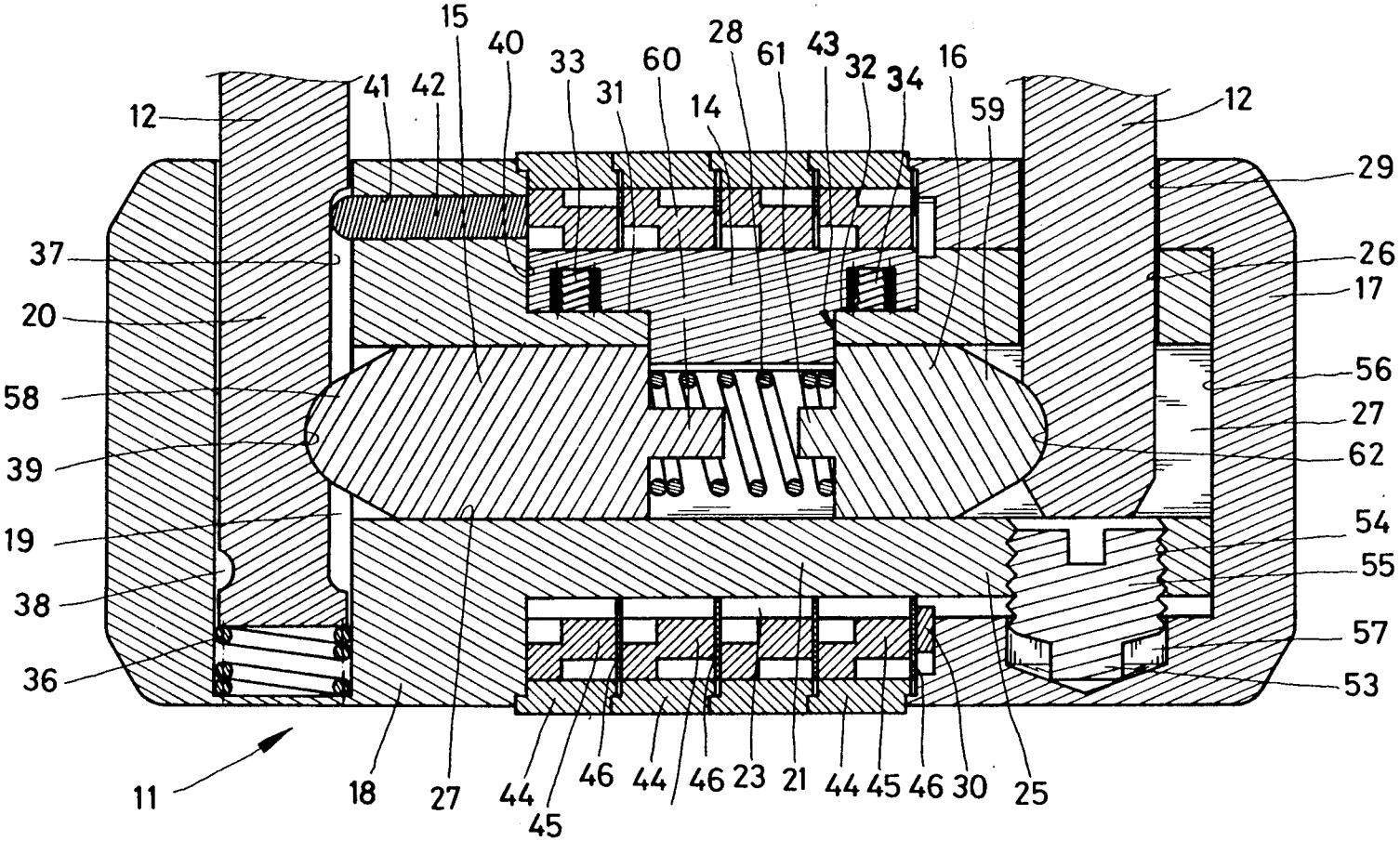
FIG. 4 is an enlarged section view of the present invention.
Figure 5:
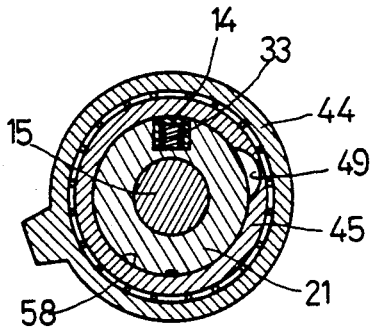
FIG. 5 is a sectional view of the present invention taken along line 5—5 in FIG. 3.
Figure 6:
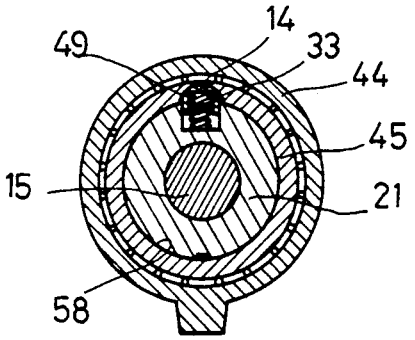
FIG. 6 is a sectional view of the present invention taken along line 6—6 in FIG. 2.
Figure 7:
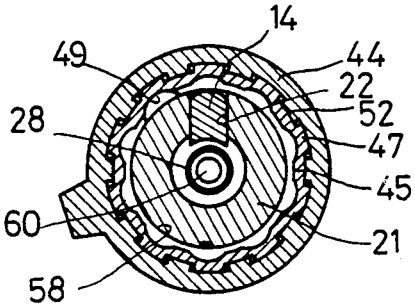
FIG. 7 is a sectional view of the present invention taken along line 7—7 in FIG. 3.
Figure 8:
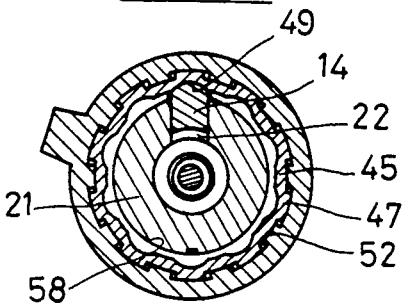
FIG. 8 is a sectional view of the present invention taken along line 8—8 in FIG. 2.
Figure 9:
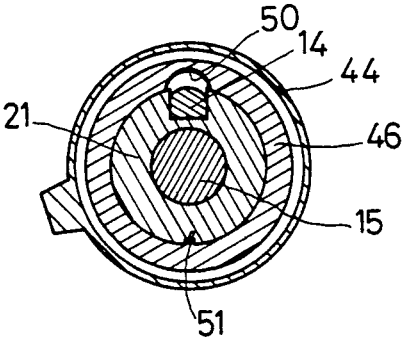
FIG. 9 is a sectional view of the present invention taken along line 9—9 in FIG. 3.
Figure 10:
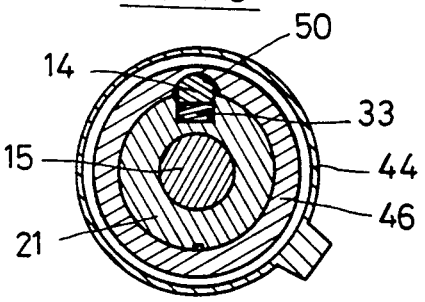
FIG. 10 is a sectional view of the present invention taken along line 10—10 in FIG. 2.

The padlock according to the present invention can be set from the un-locked condition shown in FIG. 2 into locked-up condition as shown in FIGS. 3, 5, 7, 9 by pushing the short end of shackle 12 into the round hole 29 and the shackle hole 26; then, the two lock tumblers 15 and 16 will be pushed to move inwards until moving back slightly to enter the semi-circulars recesses 39 and 62 respectively; and then move the combination wheel assembly to have the padlock locked up or un-locked. To lock up the padlock, turn the combination rings 44 to actuate the driving rings 45; then, the top of the T-shaped block 14 will be pushed downwards by the recesses 49 until the T-shaped block 14 being pushed into the T-shaped slot 22 completely, i.e., the top surface of the T-shaped block 14 being on the same level as that of the main shaft 21; finally, the lower end of T-shaped block will be inserted between the two lock tumblers 15 and 16, and the two lock tumblers will be retained in the semi-circular recesses 39 and 62 to maintain the padlock in lock-up condition.

Figure 11:
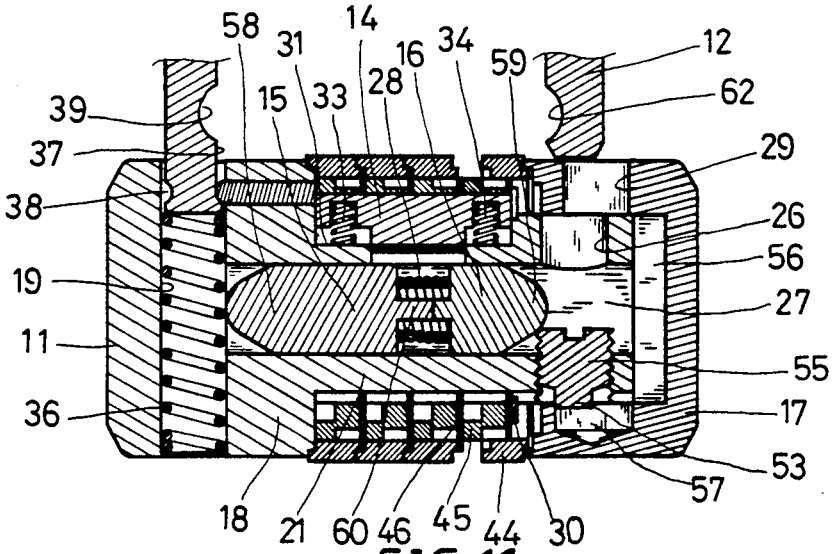
FIG. 11 is a sectional view of the present invention, showing the combination numerals being changed.

In addition to the lock-up and un-locked condition, the combination numerals of the present invention can also be changed if necessary. The procedures of changing the combination numerals can be done, as shown in FIGS. 1, 2 and 11, by setting the padlock in unlocked condition first, and then un-screw the screw 55 with a screwdriver through the round hole 29 to have the screw lifted up a suitable height until the short stud 53 being raised up to the upper edge of the cylindrical hole 57 in the cap 17; in that case, the cap is released by screw 55, and can be pulled out at a short distance, and such short distance is slightly bigger than the width of the inner surface of the combination ring 44 without teeth; then, the combination ring can be pulled out at a space so as to have the teeth of the combination ring 44 disengaged from the teeth 47 on the driving ring 45; as a result, the combination ring 44 can be turned freely so as to set a new combination numerals for the padlock. When the combination rings are pulled outwards one after another, the partition ring 46 between two driving rings 45 can prevent the combination ring from being pulled outwards too much to un-intentionally engage with another combination ring because of the outer diameter of the partition ring being bigger than the inner diameter formed by the tops of teeth in the combination ring 44, and being smaller than the diameter of the inner surface of the combination ring 44. After the new combination numerals are set, the combination rings are pushed back regularly to engage with the driving rings respectively; then, the cap 17 is assembled to the original position, and the screw 55 is also pushed to its original position; the padlock can be operated with the new combination numerals.

Briefly, the present invention is deemed a simply and a practical disclosure with high security because that it mainly comprises a body portion having a main shaft with a T-shaped slot for receiving a T-shaped block, two lock tumblers with a spring therebetween to be mounted in a center hole of the main shaft. The T-shaped block is an important member in controlling the lock-up or un-locked condition of the padlock.

What is claimed is:

1. An improved mechanism for a combination padlock comprising:

a body portion, which including one end having a bigger diameter with a shackle hole, and the other end thereof having a main shaft with a smaller diameter to be mounted with a combination wheel assembly; and a T-shaped slot being provided on said smaller diameter shaft for receiving a T-shaped block therein; and said main shaft having a round groove to be mounted with a retaining ring; and said main shaft having a center hole for mounting two lock tumblers and a spring therein; and said main shaft having a shackle hole of which the lower portion has a screw hole for receiving a screw therein; and one end of said main shaft being mounted with a cap;

a shackle having a longer end with a flat part and a round groove; and said flat part having a semi-circular recess, and a short end with a semi-circular recess;

said combination wheel assembly including several combination rings, driving rings and partition rings; and said driving rings each having a plurality of teeth on one side of the outer surface thereof, and having a driving-ring hole with a recess; and said partition rings each being a thin ring with a recess and a lug on an inner edge of said partition ring; and said partition rings being installed between two said driving rings; and the inner surface of said combination rings having a plurality of inner teeth to be engaged with the teeth on said driving rings;

said T-shaped block being movably installed in said T-shaped slot, in which at least two springs are installed; and the lower end of said T-shaped block being extended into said center hole of said main shaft and into a space between said two lock tumblers;

said two lock tumblers each having a stud, while other ends thereof being formed into semi-spherical portions; and said spring being mounted between said two lock tumblers upon the same being installed in said center hole of said main shaft;

said cap having a round hole for mounting on said main shaft after said combination wheel assembly is mounted in place; and at one side of said cap, a round hole being provided and being aligned with said shackle hole; and said cap also having a cylindrical hole on the bottom of said round hole for receiving the lower part of said screw; and said center hole being in communication with said T-shaped slot; and said T-shaped block being mounted within the inner diameter of said combination wheel assembly; and said recesses in said driving rings being used for providing said T-shaped block with a space to move upwards upon said combination wheel assembly rotating to a given position so as to have said two lock tumblers and said spring moved freely; and said padlock able to be locked up by moving said T-shaped block downwards until being engaged in said space between said two lock tumblers so as to have said semi-spherical portions of said two lock tumblers retained in said two semi-circular recesses respectively.

2. An improved mechanism for a combination padlock as claimed in claim 1, wherein both ends of said T-shaped slot having two small flat parts for mounting said two springs respectively; and said T-shaped block being rested on said two springs; and the upper part of said T-shaped slot having a suitable space to allow said T-shaped block to move up and down freely.

3. An improved mechanism for a combination padlock as claimed in claim 1, wherein said lug being engaged with a key way on said main shaft, while said recesses of said partition rings being positioned above said T-shaped block; and the outer diameter of said partition rings being smaller than the inner diameter of said combination rings, but being bigger than the inner diameter formed by the tops of the teeth in said combination ring.

* * * * *